US008235030B2

(12) United States Patent
Kaakkola et al.

(10) Patent No.: US 8,235,030 B2
(45) Date of Patent: Aug. 7, 2012

(54) PAINTBALL LOADER

(75) Inventors: Eero Kaakkola, Helsinki (FI); Adam Harrison Thorp, San Diego, CA (US)

(73) Assignee: Dye Precision, Inc., San Diego, CA (US)

( * ) Notice: Subject to any disclaimer, the term of this patent is extended or adjusted under 35 U.S.C. 154(b) by 57 days.

(21) Appl. No.: 12/787,348

(22) Filed: May 25, 2010

(65) Prior Publication Data

US 2011/0290226 A1 Dec. 1, 2011

(51) Int. Cl.
*F41B 11/02* (2006.01)

(52) U.S. Cl. ..... 124/49; 124/51.1

(58) Field of Classification Search ..... 124/49, 124/51.1

See application file for complete search history.

(56) References Cited

U.S. PATENT DOCUMENTS

| | | | | |
|---|---|---|---|---|
| 3,589,840 | A | 6/1971 | Murphy | |
| 3,610,223 | A | 10/1971 | Green | |
| 5,097,816 | A * | 3/1992 | Miller | 124/49 |
| 5,097,985 | A * | 3/1992 | Jones | 221/86 |
| 5,722,383 | A | 3/1998 | Tippmann et al. | |
| 5,749,797 | A | 5/1998 | Sunseri et al. | |
| 5,816,232 | A | 10/1998 | Bell | |
| 5,954,042 | A | 9/1999 | Harvey | |
| 6,109,252 | A | 8/2000 | Stevens | |
| 6,327,953 | B1 | 12/2001 | Andresen | |
| 6,415,781 | B1 | 7/2002 | Perrone | |
| 6,502,567 | B1 | 1/2003 | Christopher et al. | |
| 6,526,955 | B1 | 3/2003 | Juan | |
| 6,684,873 | B1 | 2/2004 | Anderson et al. | |
| 6,739,323 | B2 | 5/2004 | Tippmann, Jr. | |
| 7,017,569 | B2 | 3/2006 | Jong | |
| 7,222,617 | B2 | 5/2007 | Andresen | |
| 7,234,456 | B2 | 6/2007 | Andresen | |
| 7,270,121 | B2 | 9/2007 | Lubben | |
| 7,275,530 | B2 | 10/2007 | Deak | |
| 7,428,899 | B2 | 9/2008 | Andresen | |
| 7,568,478 | B2 | 8/2009 | Hedberg | |
| 7,591,260 | B1 | 9/2009 | Mu | |
| 7,654,255 | B2 | 2/2010 | Spicer | |
| 7,832,389 | B2 | 11/2010 | Christopher | |
| 2002/0059927 | A1 | 5/2002 | Woods | |

(Continued)

FOREIGN PATENT DOCUMENTS

DE 199 50 288 A1 4/2001

OTHER PUBLICATIONS

Archon Tacamo Gravity Paintball Hopper. Image of paintball hopper on webpage URL:http://paintball-hoppers.com/archon-tacamo-gravity-paintball-hopper/. Retrieval date: May 25, 2010. The Archon Tacamo Gravity Paintball Hopper can be prior art for purposes of the present application.

(Continued)

*Primary Examiner* — John Ricci

(74) *Attorney, Agent, or Firm* — Knobbe Martens Olson & Bear, LLP

(57) ABSTRACT

Some embodiments are directed to a paintball loader having a diverter member supported within a housing of the loader. The diverter member can limit the number of paintballs which enter an outlet passageway leading to a marker inlet. In some embodiments, diverter member can have projections and channels formed in a bottom surface thereof to control the number of paintballs that can simultaneously enter the entrance to the outlet passageway.

20 Claims, 10 Drawing Sheets

U.S. PATENT DOCUMENTS

| | | | |
|---|---|---|---|
| 2002/0092513 | A1 | 7/2002 | Christopher et al. |
| 2006/0081233 | A1 | 4/2006 | Andresen |
| 2007/0012304 | A1 | 1/2007 | van Dorsser et al. |
| 2007/0295319 | A1 | 12/2007 | Carter et al. |
| 2008/0017178 | A1 | 1/2008 | Marques et al. |
| 2009/0266349 | A1 | 10/2009 | Hedberg |
| 2010/0095942 | A1 | 4/2010 | Kaakkola et al. |

OTHER PUBLICATIONS

European Search Report & Written Opinion, Application No. EP 10 16 4831, dated Sep. 27, 2010, 7 pgs.

* cited by examiner

PAINTBALL LOADER

BACKGROUND OF THE DISCLOSURE

1. Technical Field

The present invention relates to a paintball loader, and more specifically to a paintball loader which feeds paintballs to a paintball marker.

2. Background

This disclosure relates to loaders for pneumatic paintball markers. Markers are typically used for target practice and in mock war games. The markers can use a compressed gas, such as air or nitrogen, to propel spherical projectiles called paintballs out of the barrel of the device. Paintballs are typically comprised of a colored liquid enclosed in a fragile gelatin casing. The paintballs can be designed to rupture upon impact to mark the target.

Typically, conventional loaders include a housing which is placed on an upper portion of the marker. The housing can be shaped to hold a large amount of paintballs. An outlet tube is typically located at the bottom of the housing through which the paintballs drop either by the force of gravity or by the force of a paintball feeding mechanism. The outlet tube can lead to the marker, where the paintballs are propelled outwardly from the marker by compressed air.

SUMMARY OF SOME EXEMPLIFYING EMBODIMENTS

The systems and methods of the present invention have several features, no single one of which is solely responsible for its desirable attributes. Without limiting the scope of this invention as expressed by the claims which follow, its more prominent features will now be discussed briefly. After considering this discussion, and particularly after reading the section entitled "Detailed Description of the Preferred Embodiments" one will understand how the features of this invention provide several advantages over traditional paintball loaders.

One aspect of the present invention involves a paintball loader for feeding paintballs into a paintball marker. The loader comprises a housing having a chamber therein, an inlet opening for receiving paintballs, and an outlet passageway for directing paintballs from the housing to a marker. The housing further comprises a diverter member supported within the housing above the outlet passageway. The loader is configured such that the diverter member restricts the flow of paintballs flowing through the outlet passageway.

Another aspect involves a paintball loader that comprises a housing that has an inlet passageway and an outlet passageway. The loader further comprises a diverter member supported by the housing and that has a lower surface. The diverter member is disposed over the outlet passageway and sufficiently spaced from the outlet passageway so as to allow paintballs to pass between the lower surface and the housing before entering the outlet passageway.

Another aspect involves a paintball loader that includes a housing that has an upper portion for holding a first plurality of paintballs and a lower portion for holding a second plurality of paintballs. The upper portion has an inlet opening and the lower portion has an outlet opening. The loader further includes a diverter member disposed between the upper and lower portions so as to separate at least some of the first plurality of paintballs from the second plurality of paintballs. The diverter member and the lower portion define a channel therebetween and to the outlet opening. The diverter member is disposed relative to the outlet opening so as to prevent the first plurality of paintballs from entering the outlet opening without passing through the channel.

Another aspect involves a paintball loader for feeding paintballs into a paintball marker. The loader comprises a housing having a chamber therein, an inlet opening for receiving paintballs, and an outlet passageway for directing paintballs from the housing to a marker. The loader further comprises a diverter member supported within the housing above the outlet passageway. The loader is configured such that the diverter member restricts the flow of paintballs flowing through the outlet passageway.

Another aspect involves a method of loading paintballs into a paintball marker. The method comprises supporting a paintball loader with a paintball marker such that an outlet passageway of the paintball loader is in communication with an inlet passageway of the paintball marker, filling a housing of the paintball loader at least partially with paintballs, and channeling paintballs into the outlet passageway by moving a diverter member supported within the housing in a fore and aft direction between and first and a second position.

BRIEF DESCRIPTION OF THE DRAWINGS

Embodiments of the present disclosure will now be described in more detail with reference to the following drawings, which show some exemplifying embodiments and in which.

DETAILED DESCRIPTION OF THE PREFERRED EMBODIMENTS

Figure 1:
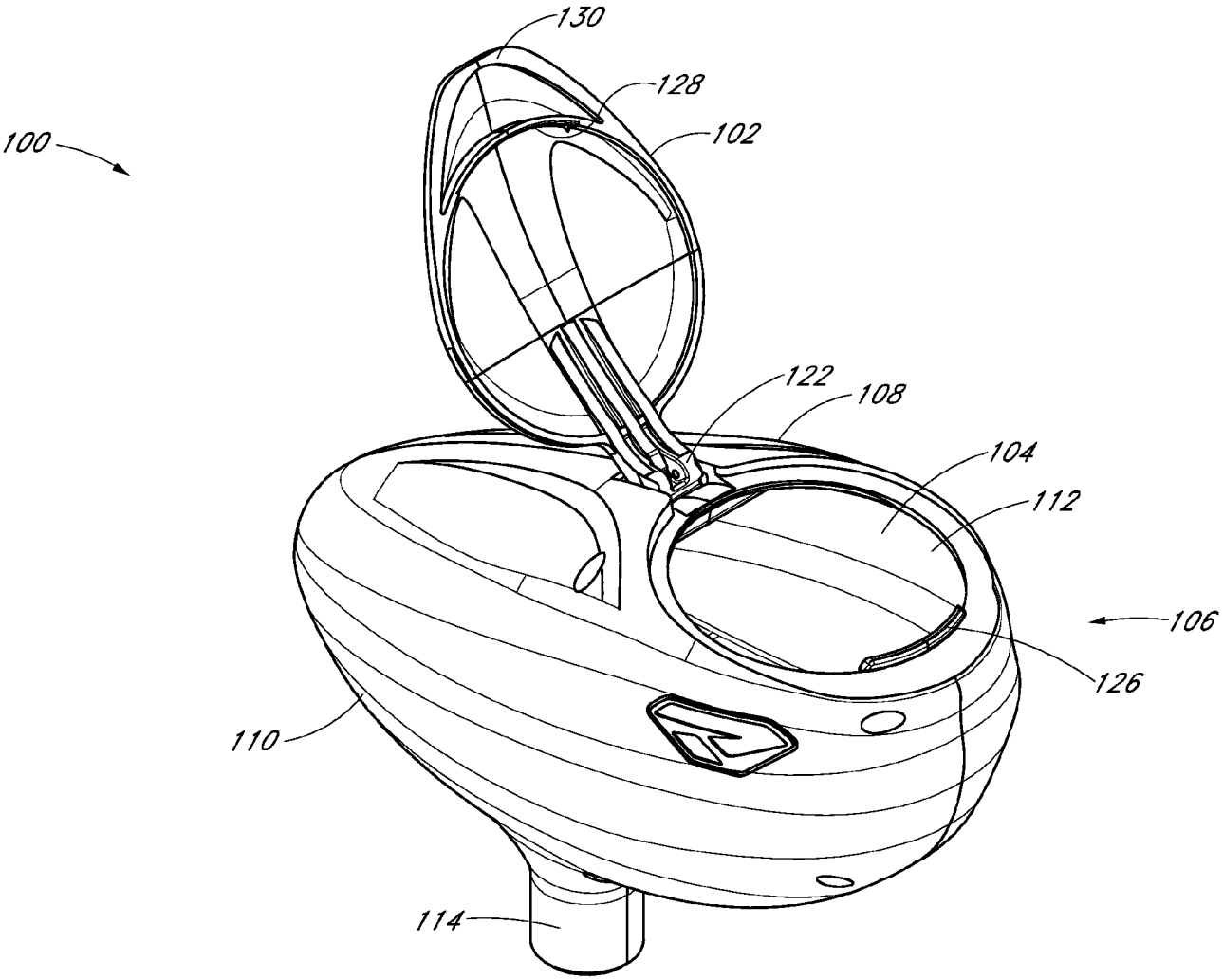
FIG. 1 is a perspective view of an embodiment of a loader, showing a lid member in an open position.
Figure 3:
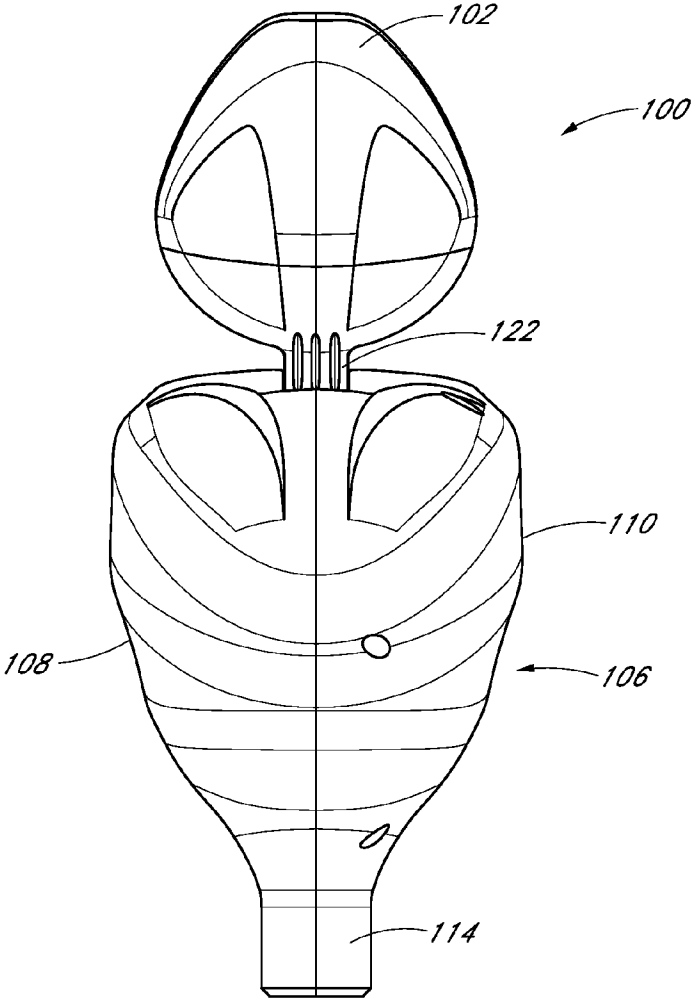
FIG. 3 is a back view of the loader shown in FIG. 1.
Figure 2:
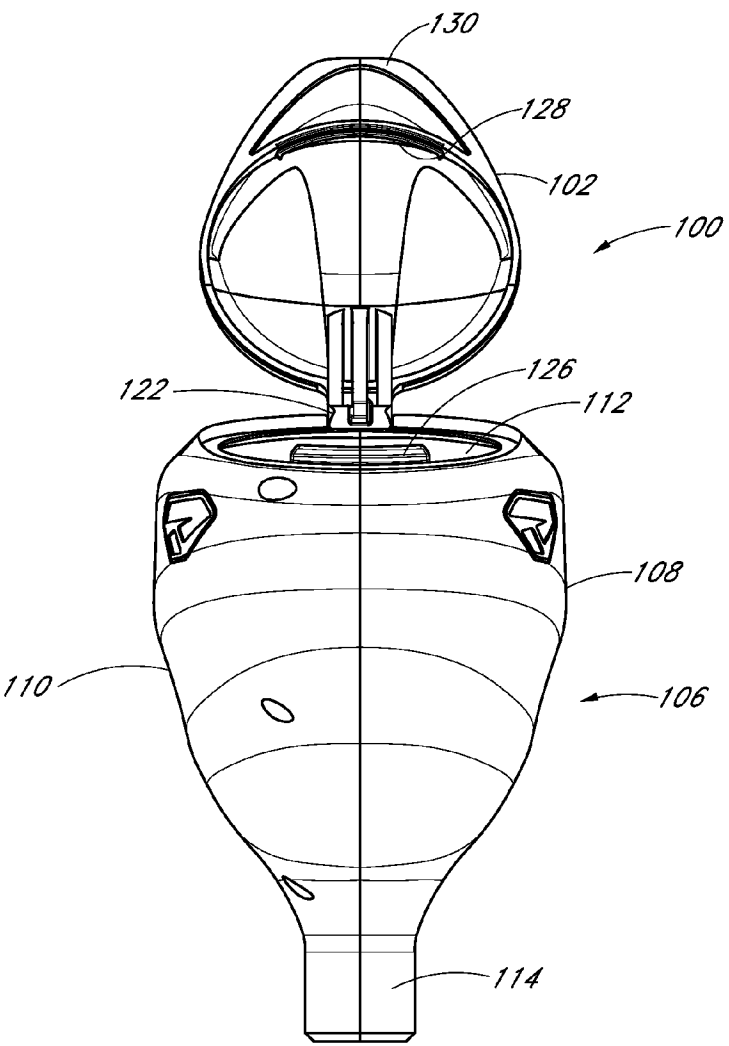
FIG. 2 is a front view of the loader shown in FIG. 1.
Figure 5:
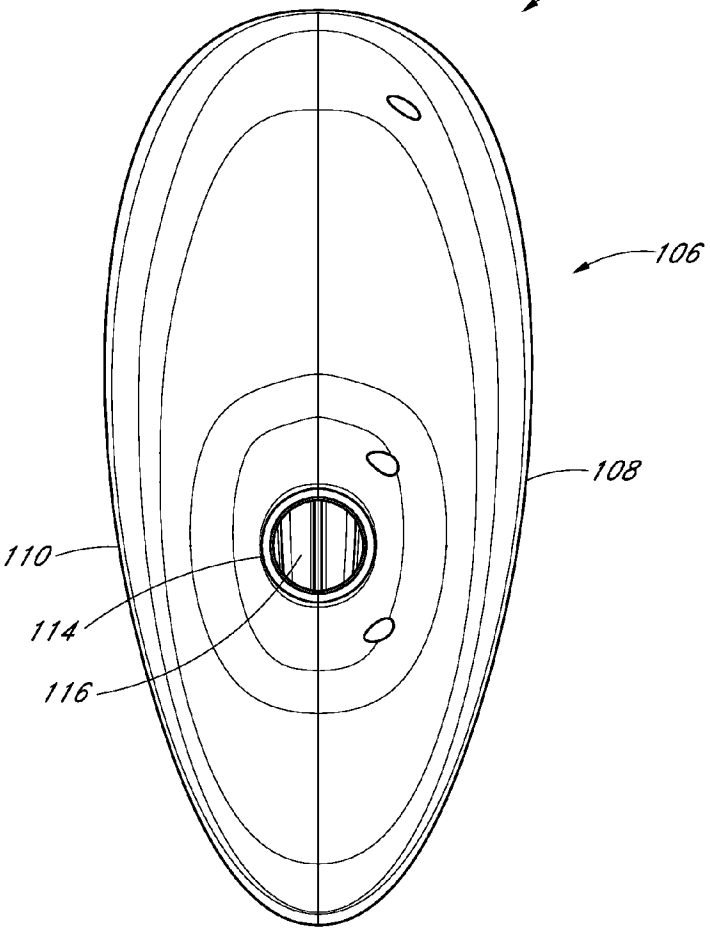
FIG. 5 is a bottom view of the loader shown in FIG. 1.
Figure 4:
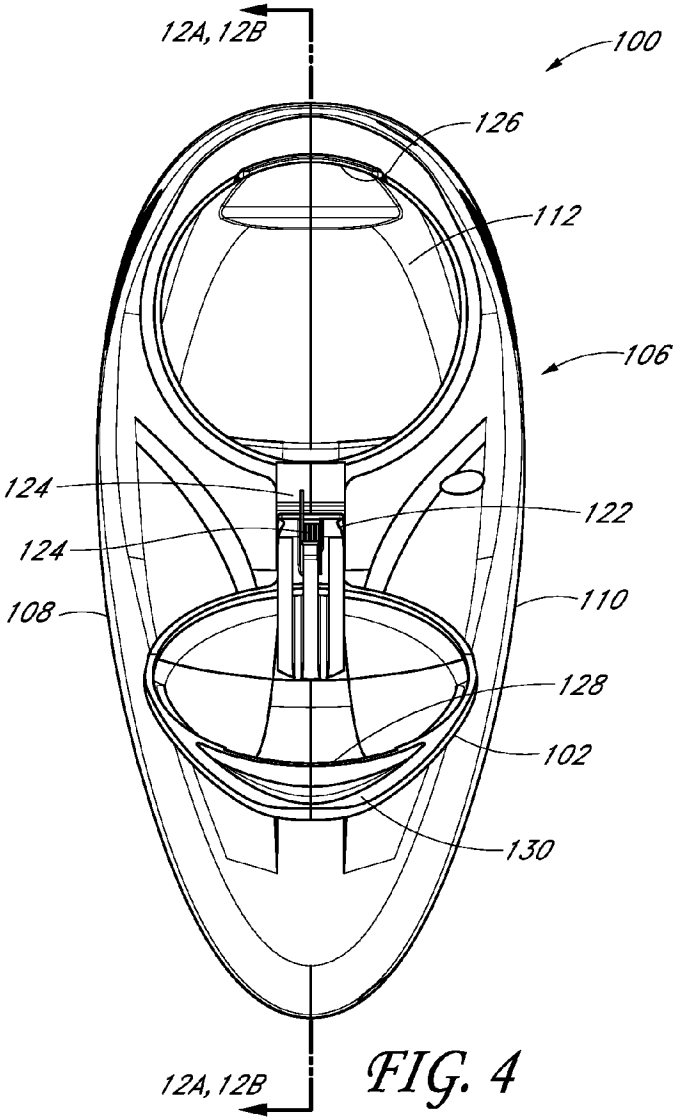
FIG. 4 is a top view of the loader shown in FIG. 1.
Figure 6:
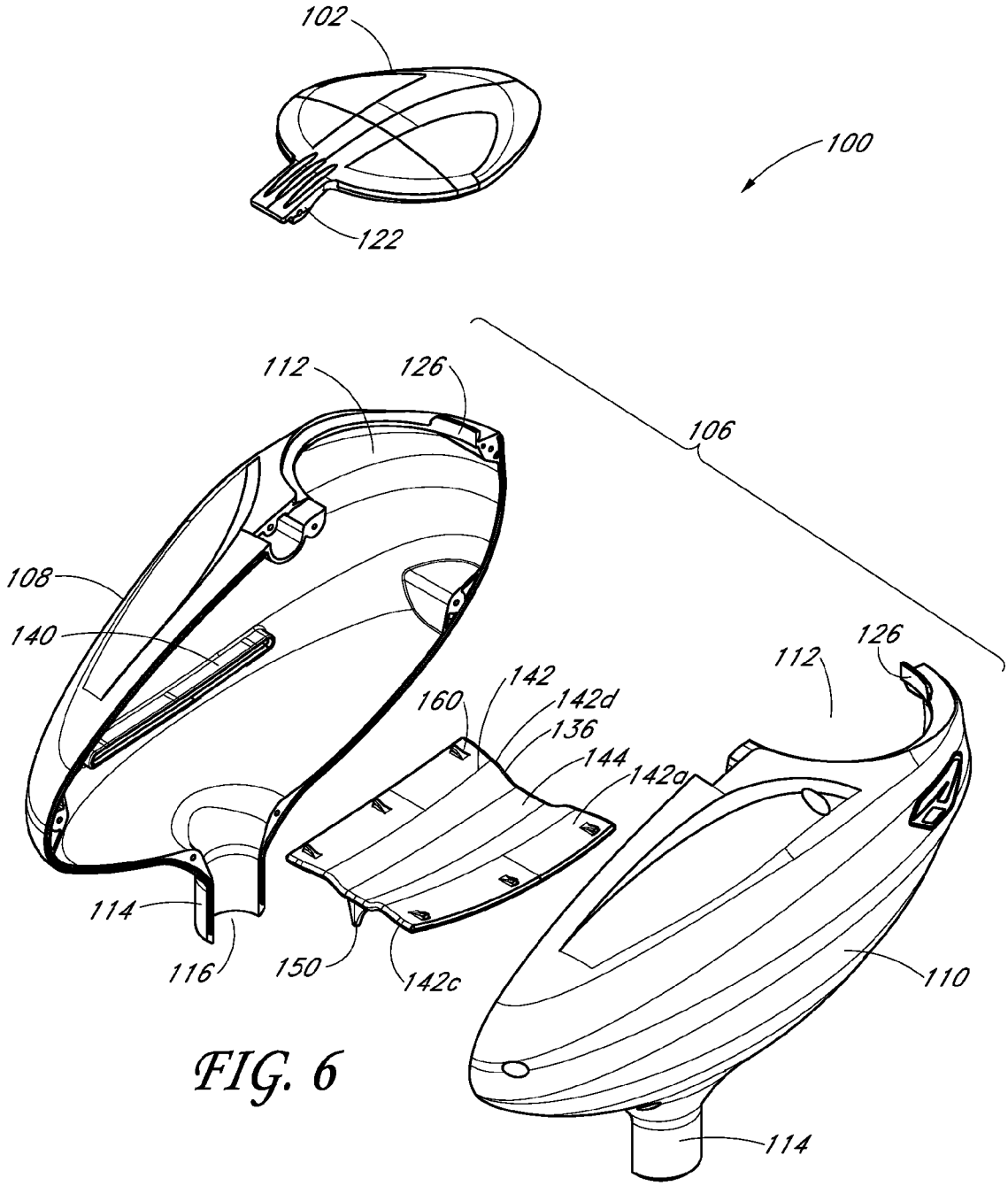
FIG. 6 is a partial exploded assembly view of the loader shown in FIG. 1.

FIGS. 1-3 are a perspective view, front view, and back view, respectively, of an embodiment of a loader 100, showing a lid member 102 in an open position. The loader 100 receives paintballs 104 (see FIG. 12A) when the lid member 102 is in the open position. FIGS. 4-5 are top and bottom views, respectively, of the loader 100 shown in FIG. 1, again showing the lid member 102 in an open position. FIG. 6 is an exploded assembly view of the loader 100 shown in FIG. 1.

Figure 7:
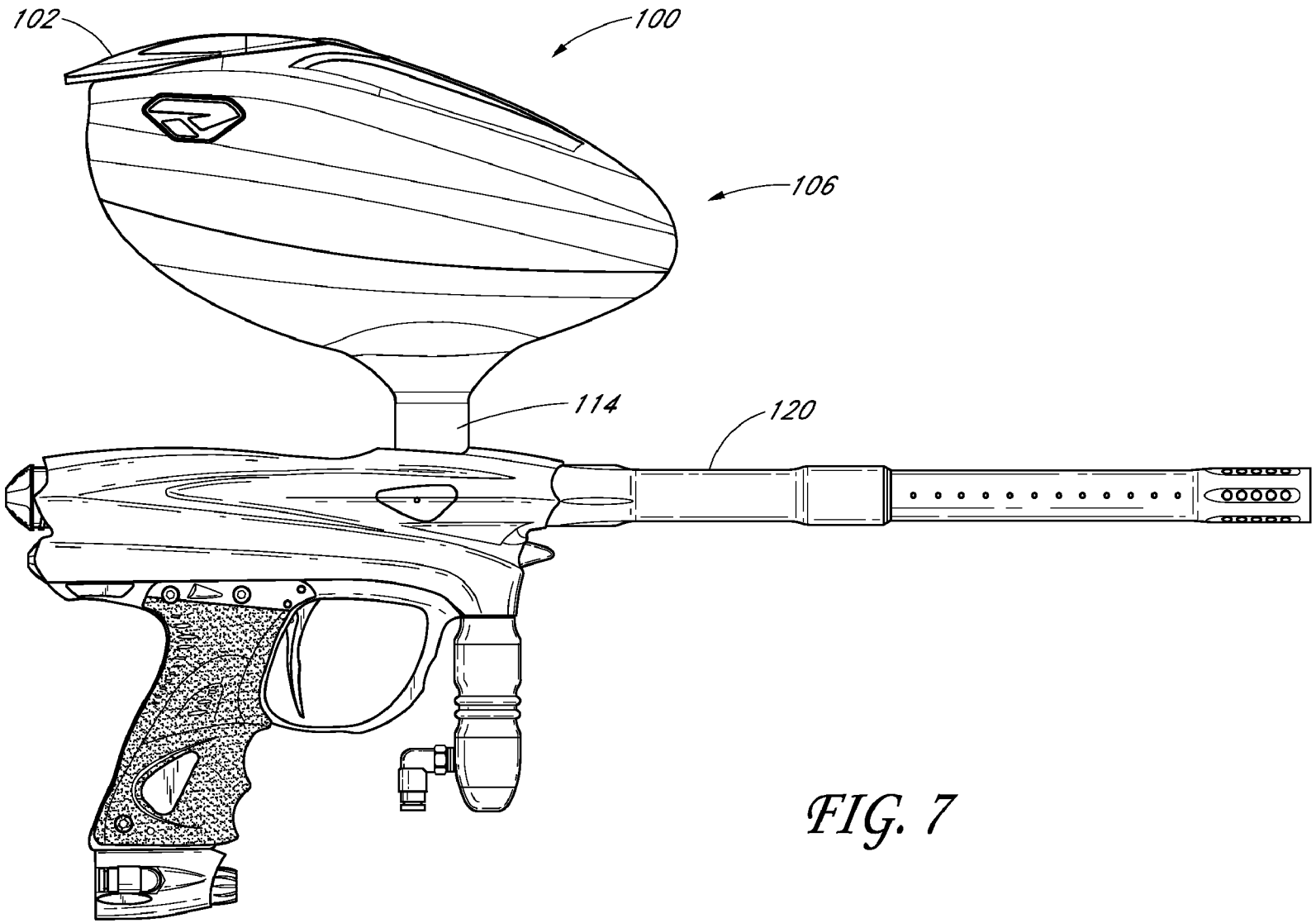
FIG. 7 is a side view of the loader shown in FIG. 1, mounted on a marker, showing the lid member in a closed position.

FIG. 7 is a side view of the loader 100 shown in FIG. 1, mounted on a marker 120, showing the lid member 102 in a closed position.

With reference to FIGS. 1-7, the loader 100 can comprise a housing or housing or casing 106. The housing 106 may have a unitary or non-unitary structure. For example, the casing 106 illustrated in FIG. 1 includes a left shell member or first casing member 108 and a right shell member or a second casing member 110, when viewed from the front (as in FIG. 2). The casing 106 can have an opening 112 formed therein, sized and configured to receive a plurality of paintballs 104 therethrough. Additionally, the casing 106 can comprise a boss 114 having an outlet passageway 116 formed therein. The boss 114 and outlet passageway 116 provide a path for paintballs 104 from the loader 102 to a marker, such as the marker 120 illustrated in FIG. 7.

In some embodiments, the lid member 102 is supported by the casing 106. In particular, the lid member 102 can have a hinge portion 122 which is rotatably supported by the casing 106 so that the lid member 102 can be rotated between an open position (such as is illustrated in FIG. 1) and a closed position (such as illustrated in FIG. 7).

In some embodiments, with reference to FIG. 4, although not necessary, the loader 100 can have a spring mechanism 124 (which can include a support rod) configured to bias the lid member 102 in the open position. In some embodiments, all or a portion of the lid member 102 is formed from a substantially transparent material, such as a plastic material, to allow a user to view at least a portion of the inside of the casing 106 so as to monitor the remaining number of paintballs 104.

The loader 100 can be configured so that the lid member 102 is selectively securable or lockable in a closed position so that paintballs 104 are securely held within the loader 100 during use of the loader 100. For example, in some embodiments, the casing 106 and the lid member 102 each have latched members 126, 128, respectively, that are configured to selectively block or snap the lid member 102 in the closed position when a user exerts a force on the lid member 102 so as to engage or secure the latch members 126, 128 to one another. In some embodiments, the loader 100 can be configured such that a user need only exert a force on the overhanging portion 130 of the lid member 102 in a direction away from the opening 112 to disengage the lid member 102 from the latch mechanism 126.

The loader 100 can be configured such that the lid member 102 is biased toward the open position. For example, as mentioned above, the spring mechanism 124 supported by the casing 106 can bias the lid member 102 toward the open position. In some embodiments, the biasing force exerted by the spring mechanism 124 on the lid member 102 toward the open position is sufficient to move the lid member 102 to the fully open position when a triggering force is exerted on the lid member 102 in a direction causing the lid member 102 to partially open.

At least a portion of the loader 100 can be transparent or translucent to allow a user to view at least a portion of the inside of the loader 100 so as to, for example, determine the approximate number of remaining paintballs 104 within the loader 100. For example, the loader 100 can have a pair of generally transparent or translucent inserts (not illustrated) supported by the casing 106, configured to allow a user to view at least a portion of the inside of the casing 106. Additionally, in some embodiments, one or more cover plates or emblems (not illustrated) can be supported at various locations on the casing 106. The translucent inserts, cover plates, and/or emblems can be supported by the casing 106 using fasteners, rivets, snaps, adhesive, or any other suitable fastening mechanisms or methods.

As mentioned, FIG. 7 is a side view of the embodiment of the loader 100 shown in FIG. 1, mounted on an exemplary marker 120, showing the lid member 102 in a closed position. The marker 120 can have a feedneck supporting member (not illustrated) configured to slidingly receive the boss 114 projecting from the casing 106 of the loader 100. In some embodiments, the feedneck on the marker 120 can have a tightening mechanism configured to constrict the feedneck around the boss 114 formed on the loader 100. For example, a clamp mechanism or a collar and lever mechanism may be employed to secure the loader 100 to the marker 120. In this assembled configuration, the balls fed by the loader 100 through the outlet passageway 116 and the boss 114 can enter the marker 120 through the feedneck formed on the marker 120, to be ultimately deployed by the marker 120 at the desired target.

With reference to FIG. 6, the loader 100 includes a diverter member 136 disposed within the casing 106. The diverter member 136 may be a unitary structure with the casing 106 or a separate member secured to the casing 106. For example, the diverter member 136 illustrated in FIG. 6 is a separate member that is secured to the casing 106 via one or more slots or channels 140. The channel 140 formed in the first casing member 108 and a similar channel 140 (not visible in FIG. 8) formed in the second casing member 110 receive outer edges of the diverter member 136 so as to support the diverter member 136 within the loader 100. Of course the diverter member 136 need not be attached on its outer edges and instead, for example, may be attached to a lower surface of the casing 106.

Figure 8:
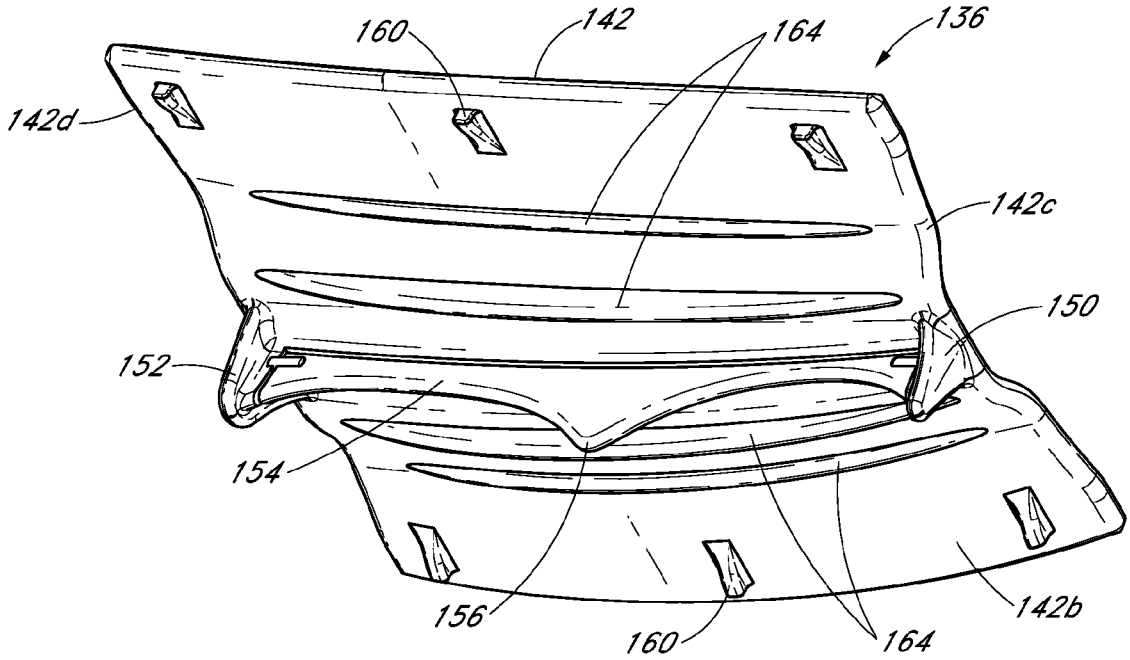
FIG. 8 is a perspective view of a diverter member disposed within the interior of the loader shown in FIG. 1.
Figure 9:
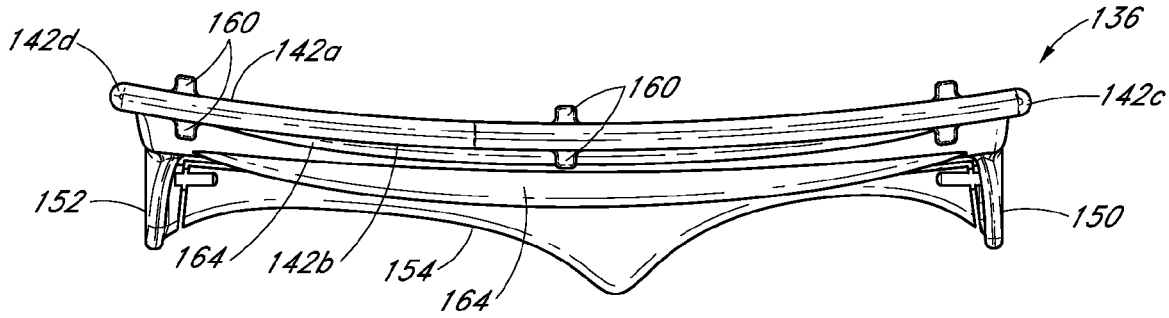
FIG. 9 is a side view of the diverter member shown in FIG. 8.
Figure 10:
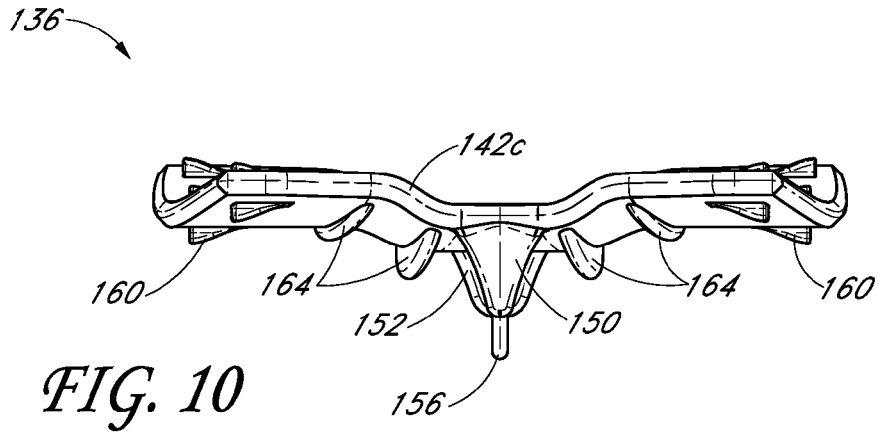
FIG. 10 is a front view of the diverter member shown in FIG. 8.

FIGS. 8-10 are perspective, side, front, and bottom views, respectively, of the diverter member 136. With reference to FIGS. 8 and 9, the diverter member 136 includes a body 142. The body 142 may have a generally concave top surface 142*a* and a generally convex bottom surface 142*b*. Further, in some embodiments, the body 142 can have a channel or depression 144 formed along a centerline plane of the body 142.

As illustrated in FIGS. 8-11, some embodiments of the diverter member 136 can have a first tabbed protrusion 150 projecting from the bottom surface 142*b* of the body 142, the tabbed protrusion 150 being positioned adjacent to a front edge 142*c* of the body 142. Similarly, some embodiments of the diverter member 136 can have a second tabbed protrusion 152 projecting from the bottom surface 142*b* of the body 142, the tabbed protrusion 152 being positioned adjacent to a rear edge 142*d* of the body 142. Further, the diverter member 136 can have an elongated protrusion 154. The elongated protrusion 154 can have one or more peaks or projections 156 projecting from the bottom surface 142*b* of the body 142 and extending between the first and second tabbed projections 150, 152 along the longitudinal centerline of the body 142. Tabs 160 can project from a top and bottom surface 142*a*, 142*b*, respectively, to secure the outer edges of the diverter member 136 in the channels 140.

Figure 12A:
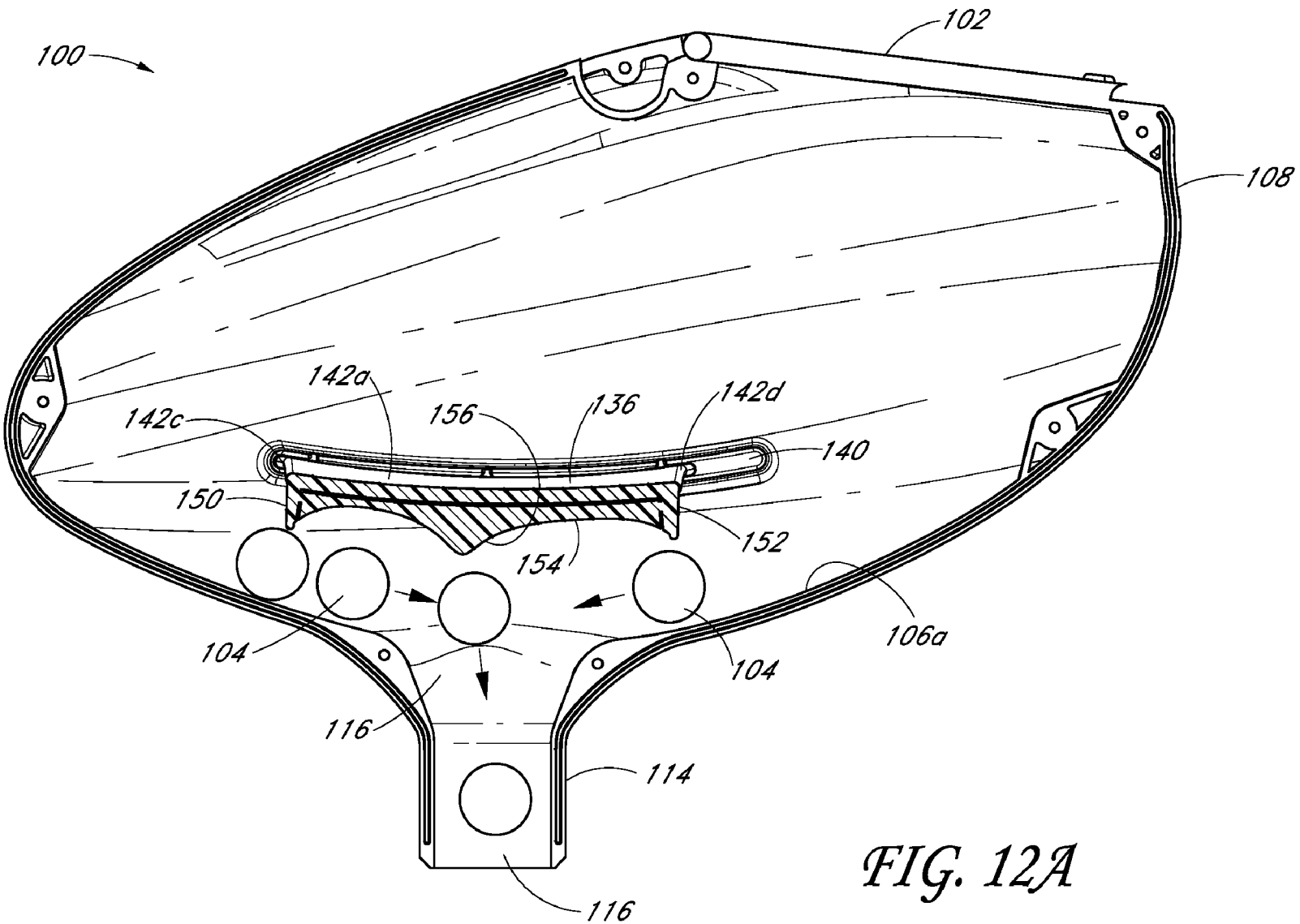
FIG. 12A is a section view along line 12A-12A of FIG. 4, showing the diverter member from FIG. 8 in a first position relative to the casing.
Figure 12B:
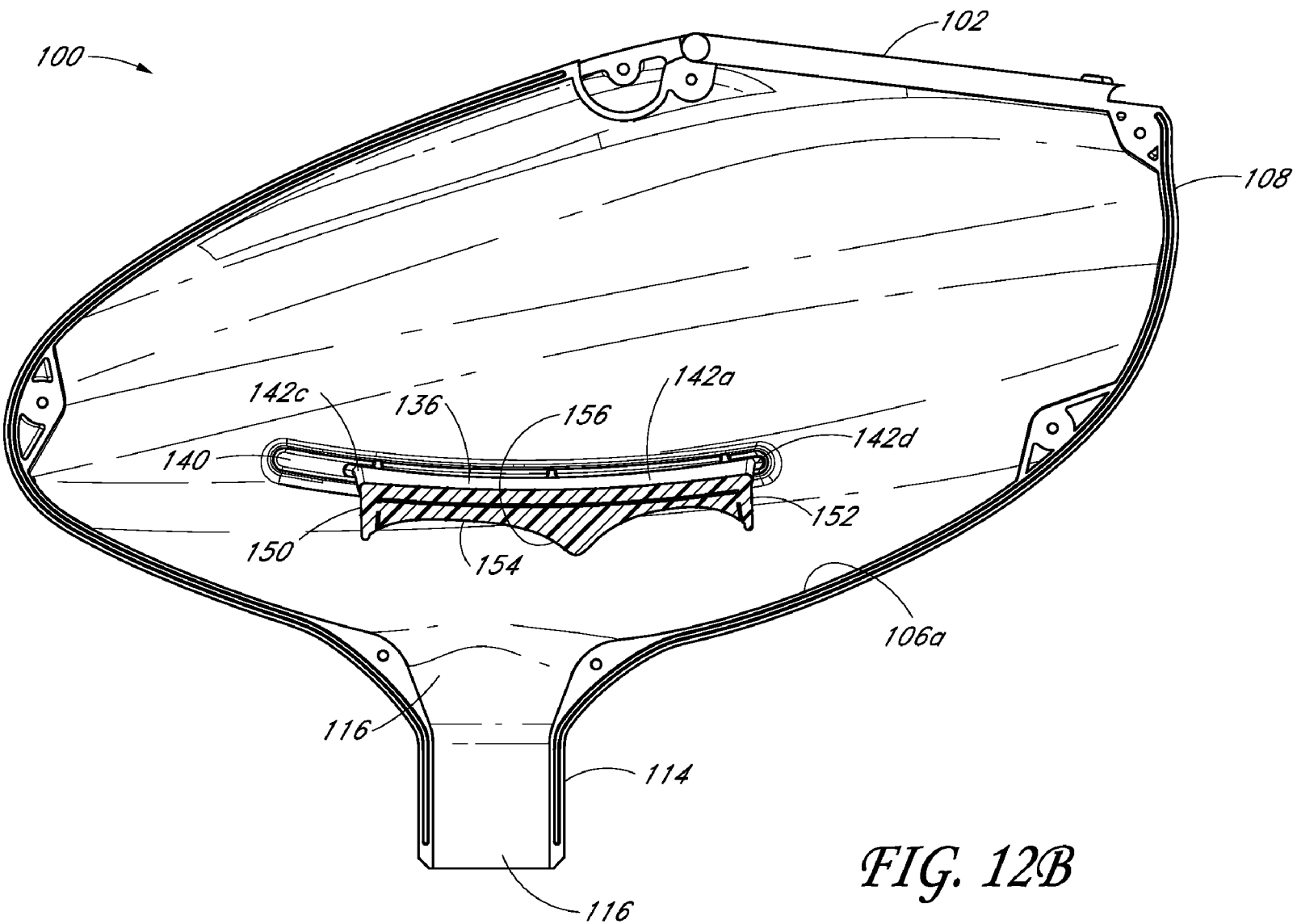
FIG. 12B is a section view along line 12B-12B of FIG. 4, showing the diverter member from FIG. 8 in a second position relative to the casing.

As mentioned above, in some embodiments, the diverter member 136 can be sized and configured to be slidably received within the channel 140 formed in the casing 106, such that the diverter member 136 can move between a first and a second position. FIG. 12A is a section view of the embodiment of the loader 100 shown in FIG. 1, taken through the line 12A-12A of FIG. 4, showing the embodiment of the diverter member 136 in a first position relative to the casing 106. FIG. 12B is a section view of the embodiment of the loader shown in FIG. 1, taken through the line 12B-12B of FIG. 4, showing the embodiment of the diverter member 136 of FIG. 8 in a second position relative to the casing 106.

Figure 13:
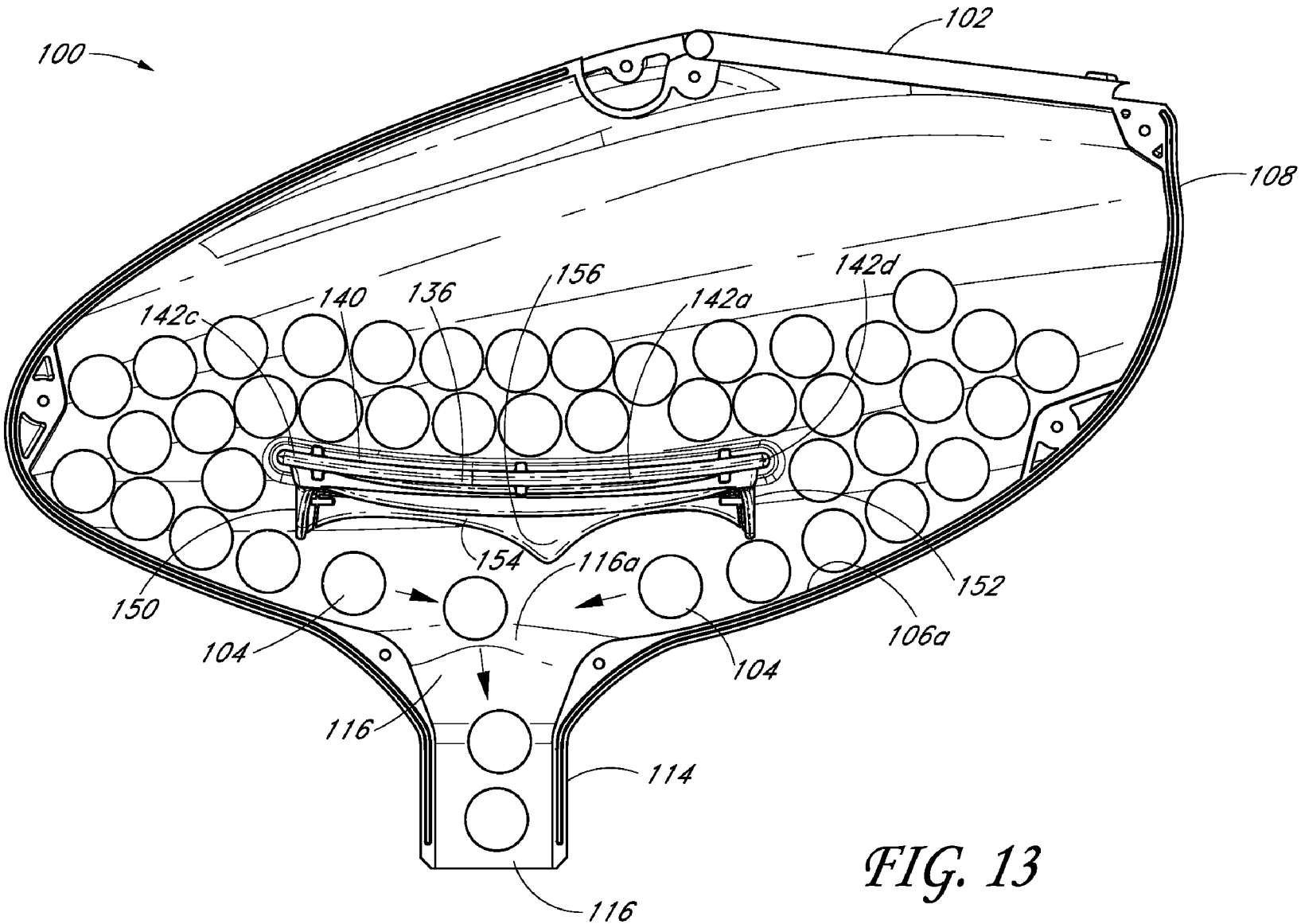
FIG. 13 is a section view of another embodiment of a loader, taken through the longitudinal centerline of the loader, with a stationary diverter member.

However, in some embodiments, the diverter member 136 can be sized and configured to be tightly supported within the channel 140 formed in the casing 106 so that the diverter member 136 is prevented from moving relative to the casing 106, as is illustrated in FIG. 13. FIG. 13 is a section view of another embodiment of a loader 100, taken through the longitudinal centerline of the loader 100, showing the diverter member 136 fixed within the casing 106.

With reference to FIGS. 12A, 12B, and 13, the diverter member 136 can be positioned above the outlet passageway 116 of the casing 106. Positioning the diverter member 136 above the outlet passageway 116 diverts at least some of the paintballs 104 supported within the casing 106 away from the outlet passageway 116 so as to limit the number of paintballs 104 that can be simultaneously channeled into the entrance to the outlet passageway 116. In this arrangement, the diverter member 136 can limit or restrict the flow of paintballs 104 into the outlet passageway 116. This can prevent or reduce the risk of paintball jams in the outlet passageway 116 that may otherwise result from too many paintballs simultaneously gathering at the entrance 116*a* of the opening or from the combined weight of the paintballs 104. In other words, the diverter member 136 can reduce the congestion of paintballs 104 that may otherwise occur without the use of the diverter member 136, and reduce the weight of the paintballs 104 exerted on the paintballs 104 positioned within or adjacent to the entrance 116*a* to the outlet passageway 116. This can help increase the free flow of paintballs 104 into the entrance 116*a* to the passageway 116 and, hence, limit or reduce instances of paintball jams.

In some embodiments, the projections 150, 152 positioned at the front and rear edges 142*c*, 412*d*, respectively, of the body 142 can also limit or channel the number of paintballs that can simultaneously enter the outlet passageway 116 or fill the entrance 116*a* to the outlet passageway 116 by impeding paintballs 104 from entering the space beneath the diverter member 136. Moreover, in some embodiments, one or more elongated protrusions 164 formed in the bottom surface 142*b* of the body 142 channel the paintballs 104 in an orderly fashion to the entrance 116*a* of the outlet passageway 116 and prevent too many paintballs 104 from entering the entrance 116*a* of the outlet passageway 116, thereby further reducing the risk of paintball jams at the entrance 116*a* to the outlet passageway 116.

Figure 11:
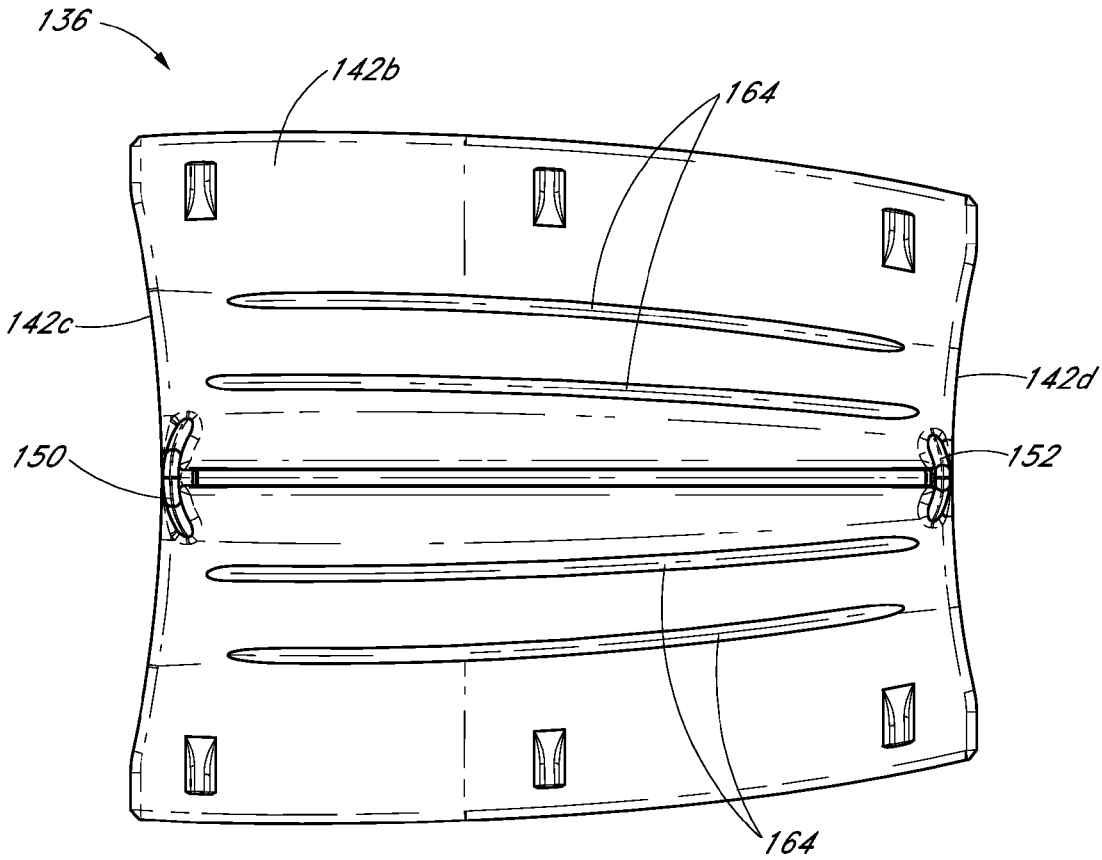
FIG. 11 is a bottom view of the diverter member shown in FIG. 8.

In some embodiments, including both the movable and stationary diverter member embodiments shown in FIGS. 10 and 11, respectively, the diverter member 136 can be supported within the casing 106 such that the projections 150, 152, 154, 156 project downwardly, toward a bottom or floor surface 106*a* of the casing 106. In either arrangement, the projections 150, 152, 154, 156 can be configured to channel paintballs 104 in an orderly fashion into the outlet passageway 116 during the operation or use of the loader 100, as illustrated in FIGS. 11 and 12, particularly when the casing 106 is being shaken fore and aft and/or side to side.

For example, in some embodiments of either arrangement, the peak projection 156 can be configured to direct paintballs directly through the outlet passageway 116, and the projections 150, 152 can be configured to direct paintballs toward the outlet passageway 116 during the use or operation of the loader 100, particularly when the casing 106 is being shaken fore and aft and/or side to side. The projections 150, 152, 154, 156 can also prevent and/or help clear jamming of paintballs 104 in the loader 100 by striking and moving the paintballs 104 around inside the casing 106. Additionally, in the movable diverter member embodiments, the movement of the diverter member 136 can increase the magnitude of the pushing force of the diverter member 136 on the paintballs 104 when the loader is shaken fore and aft sufficiently to cause the diverter member 136 to move fore and aft within the channel 140.

In some embodiments, the casing 106 can be configured to have a capacity to hold up to approximately 200 paintballs or less. In some embodiments, the casing 106 can be configured to have a capacity to hold up to approximately 300 paintballs, or, in some embodiments, up to approximately 400 paintballs or more.

Some embodiments of the loader 100 can be molded or otherwise formed from nylon, delrin, polycarbonate, polyurethane, or any other suitable plastic or other material, or combination thereof. Additionally, any of the suitable components comprising the loader 100 can be formed from a fiber reinforced material, such as glass or carbon reinforced plastics, or a combination of fiber reinforced materials and any other suitable materials. Further, some embodiments of the loader described herein can include any of the components, features, details, and other aspects of the embodiments of the loader described in U.S. patent application Ser. No. 11/258,100, titled Paintball Loader, filed on Oct. 26, 2005, the entirety of which is hereby incorporated by reference as if fully set forth herein.

Although the inventions have been disclosed in the context of a certain preferred embodiments and examples, it will be understood by those skilled in the art that the present disclosure extends beyond the specifically disclosed embodiments to other alternative embodiments and/or uses of the embodiments and obvious modifications and equivalents thereof. In addition, while a number of variations of the embodiments have been shown and described in detail, other modifications, which are within the scope of this disclosure, will be readily apparent to those of skill in the art based upon this disclosure. It is also contemplated that various combinations or subcombinations of the specific features and aspects of the embodiments may be made and still fall within the scope of the disclosure. Accordingly, it should be understood that various features and aspects of the disclosed embodiments can be combined with or substituted for one another in order to form varying modes of the disclosed embodiments. Thus, it is intended that the scope of the present disclosure should not be limited by the particular disclosed embodiments described above but by a fair reading of the claims which follow.

What is claimed is:

1. A paintball loader for feeding paintballs into a paintball marker, the loader comprising:

a housing having a chamber therein, an inlet opening for receiving paintballs, and an outlet passageway for directing paintballs from the housing to a marker; and a diverter member supported within the housing above the outlet passageway, wherein the loader is configured such that the diverter member restricts the flow of paintballs flowing through the outlet passageway, and wherein the diverter member comprises one or more tabs projecting from a bottom surface thereof, the tabs configured to obstruct the movement of paintballs to the outlet passageway.

2. The paintball loader according to claim 1, wherein the diverter member is supported within at least one channel formed inside the housing.

3. A paintball loader comprising:

a housing having an inlet passageway and an outlet passageway; and a diverter member supported by the housing and having a lower surface, the diverter member being disposed over the outlet passageway and sufficiently spaced from the outlet passageway so as to allow paintballs to pass between the lower surface and the housing before entering the outlet passageway, wherein the lower surface and the housing define a channel through which the paintballs pass before entering the outlet passageway, the channel generally being perpendicular to the outlet passageway.

4. The paintball loader according to claim 3, wherein the diverter member is sized and shaped to only allow paintballs that pass between the lower surface and the housing to enter the outlet passageway.

5. The paintball loader according to claim 3, wherein the diverter member is disposed within the housing.

6. The paintball loader according to claim 3, wherein the channel is generally perpendicular to the inlet passageway.

7. The paintball loader according to claim 3, wherein the channel has two inlets, each inlet being disposed on opposite ends of the channel.

8. The paintball loader according to claim 3 further comprising a fin projecting from the lower surface of the diverter member towards the outlet passageway, the fin defining at least a portion of the channel.

9. The paintball loader according to claim 8, wherein the fin has a curvilinear lower surface and at least one protrusion, the at least protrusion being disposed directly over the outlet passageway.

10. A paintball loader comprising:

a housing having an upper portion for holding a first plurality of paintballs and a lower portion for holding a second plurality of paintballs, the upper portion having an inlet opening and the lower portion having an outlet opening; and a diverter member disposed between the upper and lower portions so as to separate at least some of the first plurality of paintballs from the second plurality of paintballs, the diverter member and the lower portion defining a channel therebetween and to the outlet opening, the diverter member being disposed relative to the outlet opening so as to prevent the first plurality of paintballs from entering the outlet opening without passing through the channel, wherein the diverter member has a generally rectangular planar shape defining four edges, and wherein the diverter member has a sufficient width relative to the housing to prevent the first plurality of paintballs from passing between at least some of the four edges and the housing.

11. A paintball loader for feeding paintballs into a paintball marker, the loader comprising:

a housing having a chamber therein, an inlet opening for receiving paintballs, and an outlet passageway for directing paintballs from the housing to a marker; and a diverter member supported within the housing above the outlet passageway, wherein the loader is configured such that the diverter member restricts the flow of paintballs flowing through the outlet passageway, and wherein the diverter member comprises one or more tabs projecting from a bottom surface thereof, the tabs configured to reduce the number of paintballs that can move into the outlet passageway.

12. A paintball loader for feeding paintballs into a paintball marker, the loader comprising:

a housing having a chamber therein, an inlet opening for receiving paintballs, and an outlet passageway for directing paintballs from the housing to a marker; and a diverter member supported within the housing above the outlet passageway, wherein the loader is configured such that the diverter member restricts the flow of paintballs flowing through the outlet passageway, wherein the diverter member comprises one or more elongated protrusions projecting from a bottom surface thereof, the elongated protrusions configured to channel paintballs to the outlet passageway.

13. A paintball loader for feeding paintballs into a paintball marker, the loader comprising:

a housing having a chamber therein, an inlet opening for receiving paintballs, and an outlet passageway for directing paintballs from the housing to a marker; and a diverter member supported within the housing above the outlet passageway, wherein the loader is configured such that the diverter member restricts the flow of paintballs flowing through the outlet passageway, wherein the diverter member is supported within at least one channel formed inside the housing.

14. A paintball loader for feeding paintballs into a paintball marker, the loader comprising:

a housing having a chamber therein, an inlet opening for receiving paintballs, and an outlet passageway for directing paintballs from the housing to a marker; and a diverter member supported within the housing above the outlet passageway, wherein the loader is configured such that the diverter member restricts the flow of paintballs flowing through the outlet passageway, wherein the diverter member is movable in a fore and aft direction between a first and a second position within the housing.

15. A paintball loader comprising:

a housing having an inlet passageway and an outlet passageway; and a diverter member supported by the housing and having a lower surface, the diverter member being disposed over the outlet passageway and sufficiently spaced from the outlet passageway so as to allow paintballs to pass between the lower surface and the housing before entering the outlet passageway, wherein the diverter member has a generally rectangular planar shape defining four edges, and wherein the diverter member has a sufficient width relative to the housing to prevent the paintballs from passing between at least some of the four edges and the housing.

16. A paintball loader comprising:

a housing having an upper portion for holding a first plurality of paintballs and a lower portion for holding a second plurality of paintballs, the upper portion having an inlet opening and the lower portion having an outlet opening; and a diverter member disposed between the upper and lower portions so as to separate at least some of the first plurality of paintballs from the second plurality of paintballs, the diverter member and the lower portion defining a channel therebetween and to the outlet opening, the diverter member being disposed relative to the outlet opening so as to prevent the first plurality of paintballs from entering the outlet opening without passing through the channel, wherein the channel is generally perpendicular to a passageway through the outlet opening.

17. The paintball loader according to claim 16, wherein the diverter member comprises one or more tabs projecting from a bottom surface thereof, the tabs configured to reduce the number of paintballs that can move into the outlet opening.

18. The paintball loader according to claim 16, wherein the diverter member comprises one or more elongated protrusions projecting from a bottom surface thereof, the elongated protrusions configured to channel paintballs to the outlet opening.

19. A paintball loader comprising:

a housing having an upper portion for holding a first plurality of paintballs and a lower portion for holding a second plurality of paintballs, the upper portion having an inlet opening and the lower portion having an outlet opening; and a diverter member disposed between the upper and lower portions so as to separate at least some of the first plurality of paintballs from the second plurality of paintballs, the diverter member and the lower portion defining a channel therebetween and to the outlet opening, the diverter member being disposed relative to the outlet opening so as to prevent the first plurality of paintballs from entering the outlet opening without passing through the channel, wherein the channel has two inlets, each inlet being disposed on opposite ends of the channel.

20. A paintball loader comprising:

a housing having an upper portion for holding a first plurality of paintballs and a lower portion for holding a second plurality of paintballs, the upper portion having an inlet opening and the lower portion having an outlet opening; and a diverter member disposed between the upper and lower portions so as to separate at least some of the first plurality of paintballs from the second plurality of paintballs, the diverter member and the lower portion defining a channel therebetween and to the outlet opening, the diverter member being disposed relative to the outlet opening so as to prevent the first plurality of paintballs from entering the outlet opening without passing through the channel, wherein at least a portion of the diverter member is convex.

* * * * *